United States Patent [19]

Gordon

[11] 4,008,846

[45] Feb. 22, 1977

[54] LEAKPROOF PAPERBOARD CONTAINER

[75] Inventor: Robert L. Gordon, Monroe, N.Y.

[73] Assignee: International Paper Company, New York, N.Y.

[22] Filed: May 10, 1976

[21] Appl. No.: 685,014

[52] U.S. Cl. ..... 229/4.5; 229/21; 229/5.5; 229/5.6; 229/5.7

[51] Int. Cl.[2] ..... B65D 3/04; B65D 3/10

[58] Field of Search ..... 229/21, 5.5, 5.6, 5.7, 229/5.8, 45

[56] References Cited

UNITED STATES PATENTS

| | | | |
|---|---|---|---|
| 1,265,932 | 5/1918 | Maltby | 229/5.8 |
| 1,968,270 | 7/1934 | Thiebaut | 229/5.5 |
| 2,052,109 | 8/1936 | Oliver | 229/5.7 X |
| 2,058,592 | 10/1936 | Karlsson-Ygger | 229/4.5 |
| 2,097,893 | 11/1937 | Reich | 229/5.5 |
| 2,125,417 | 8/1938 | Baker | 229/5.5 |
| 2,367,688 | 1/1945 | Powell | 229/5.8 |
| 2,367,705 | 1/1945 | Wansker | 229/5.7 |
| 2,416,813 | 3/1947 | Barbieri | 229/21 |
| 2,989,219 | 6/1961 | Overtom | 229/5.7 |
| 3,248,035 | 4/1966 | Gay et al. | 229/5.7 |
| 3,402,876 | 9/1968 | Kuchembecker | 229/21 X |
| 3,712,530 | 1/1973 | Croley | 229/5.7 X |

FOREIGN PATENTS OR APPLICATIONS

| | | | |
|---|---|---|---|
| 52,403 | 3/1911 | United Kingdom | 229/5.6 |
| 69,841 | 1/1913 | United Kingdom | 229/5.6 |

*Primary Examiner*—Davis T. Moorhead
*Attorney, Agent, or Firm*—Richard J. Ancel

[57] ABSTRACT

A substantially leakproof container, particularly adapted for the shipment and storage of frozen liquids, liquid materials, and moisture sensitive materials, is provided. The body of the container comprises a generally cylindrical side or body wall portion and an integral base portion and is constructed from a unitary, thermoplastic coated, paperboard blank. The side or body wall portion is foldably connected to the base portion. The base portion comprises a plurality of foldably connected panels, the panels being folded in such a manner as to form first and second upstanding member whereby an annular channel is formed between the two upstanding members. The first upstanding member comprises at least one panel which lies in face-to-face contact with the lower surface of the cylindrical body wall portion. This panel is of greater height than the height of the second upstanding member. The second upstanding member comprises, preferably, two foldably connected panels, one of which is joined to the bottom edge of one panel of the first upstanding member and the other of which is joined to the bottom edge of the body wall portion of the container. A first end closure member or plug seals the base portion of the container and includes a downwardly projecting peripheral flange that occupies the annular channel formed between the two upstanding members. A second end closure member or cap is provided for sealing the upper end of the container. The container is rugged and is designed to maintain its substantially leakproof condition when its bottom edge is subjected to impact occasioned by the dropping of the container during its shipment and/or storage.

33 Claims, 10 Drawing Figures

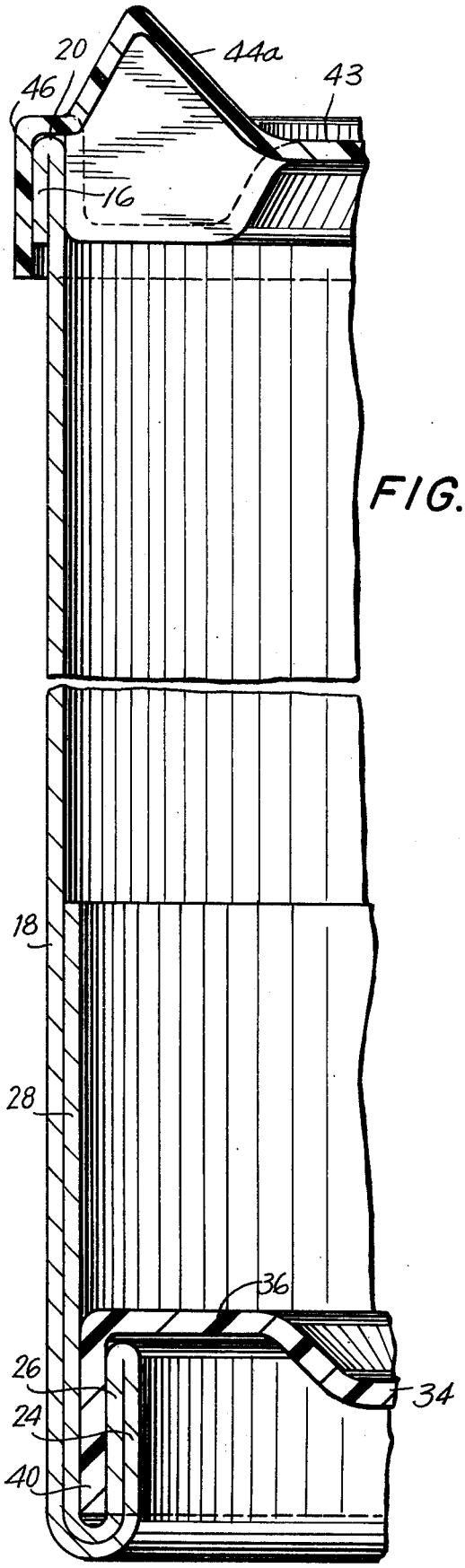
FIG. 6
FIG. 5
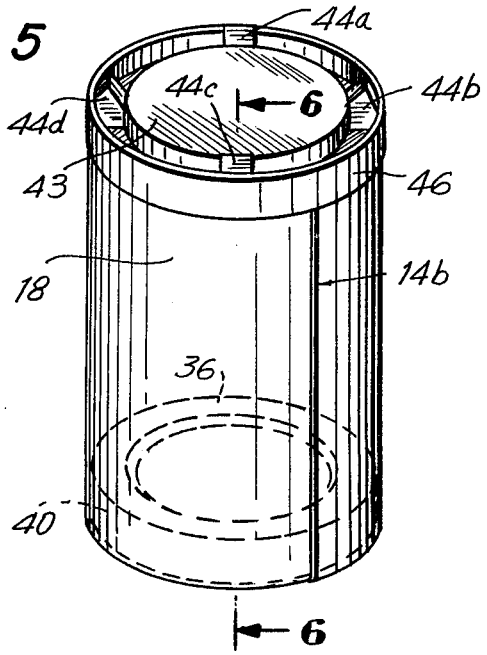
FIG. 7
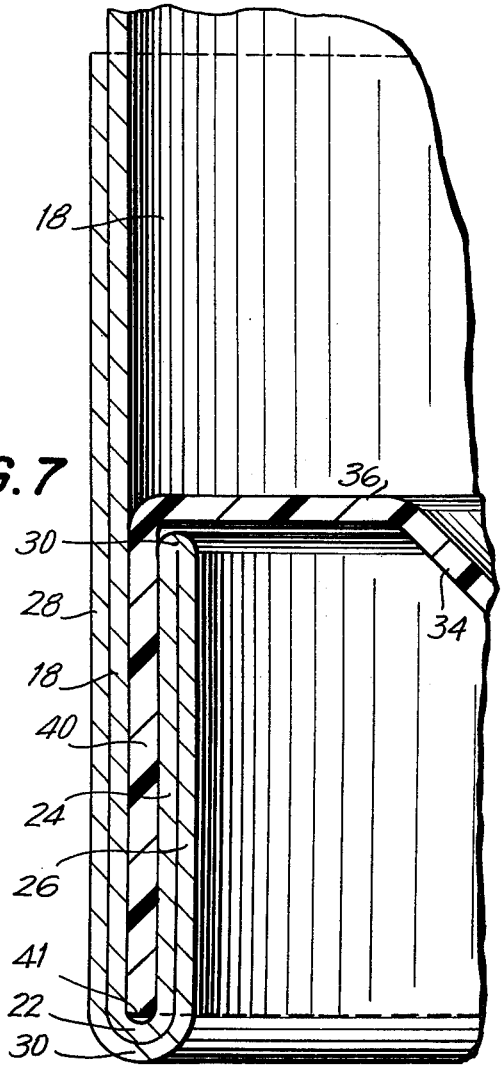

LEAKPROOF PAPERBOARD CONTAINER

BACKGROUND OF THE INVENTION

This invention relates to a substantially leakproof container. The body of the container is constructed from a unitary, thermoplastic coated paperboard blank, and two end closure members seal the container formed from the blank. This invention particularly relates to a container provided with a base portion of improved strength and durability which enables the container to maintain its substantially leakproof condition should the container, when filled, be dropped on its base portion during transport or storage.

While numerous articles may be packaged in this container, it is particularly useful in the packaging of materials that require enclosure within a container having good moisture barrier properties. In particular, this container is adapted for the shipment and storage of frozen liquids, liquid materials, and moisture sensitive materials.

In certain industries, it is common to package a liquid material in a container, freeze the liquid material within the container, and ship the frozen material, still within the original container, to the user. The user then stores the frozen material until the material is needed, at which time the user defrosts the material. For example, it is a common practice for bakeries that bake goods on a large scale for distribution to retail outlets to buy pails of raw, shelled eggs. Such eggs are purchased from dairy processors, who shell the eggs and then pour the shelled eggs into a pail that holds approximately thirty pounds of eggs. The eggs, which are then sealed in the pail, are frozen or "blast frozen" and shipped in the frozen state to the baked goods manufacturer. At the bakery, the frozen eggs, still in the original, shipping container, are kept in frozen storage until they are required for use. When it is necessary to use the eggs, the container is removed from the freezer, and the eggs are allowed to be defrosted so that they return to the liquid state. Obviously, if the shipping container has been dropped on its base portion at any time during its transport or storage, as the frozen material returns to the liquid state, it may leak through the cracks in the container. Also, while the material is still in the frozen state, if the container has been dropped and its external surface has been fractured, the product within the container may become contaminated.

At the present time, there are several methods used in the packaging of liquid materials, such as eggs, that are subsequently frozen, shipped, and then defrosted prior to use. One approach employs metal pails; a second approach employs solid plastic pails. Containers made from these materials, however, are expensive and may be subject to fracture. It has been found, for example, that when a metal pail filled with the frozen material is dropped, the welded side seam, or the welded joint that encircles the base portion of the pail, may have a tendency to split. Solid plastic pails may fracture at the area of impact.

Paperboard containers, having at least one upper or lower closure member, for containing liquids are generally known in the art. See, for example, U.S. Pat. Nos. 1,968,270; 2,058,592; 2,097,893; 2,125,417; and 2,416,813. None of these references, however, discloses a container adapted for use in an industry where large or heavy amounts of liquid materials are required to be packaged, frozen, transported over distances, stored and defrosted, all within the original packaging container. Such an industry requires a relatively inexpensive container that can be assembled automatically, quickly filled with the goods to be shipped, sealed, placed in vertical stacks during its shipping and storage periods, and can still maintain its substantially leakproof condition when subjected to rough handling and dropping during its transport or storage. In addition, such a container must be suitable to allow the goods to be defrosted therewithin when they are required to be used.

SUMMARY OF THE INVENTION

The present invention provides a container having a cylindrical paperboard body that is sealed at both ends by end closure members, which preferably, are made from a plastic material. It is characterized by a base wall portion that is of improved strength and rigidity, so that if the container, when filled, is dropped on its bottom edge, the integrity of the leakproof barrier is maintained, protecting the materials therewithin.

The preferred embodiment of the invention comprises a container body having a generally cylindrical side or body wall portion and an integral base wall portion. It is constructed from a unitary, rectangular paperboard blank. Preferably, the blank is coated on both sides with a thermoplastic material such as polyethylene or polypropylene. A preferable coating thickness is approximately one mil, and a preferable basis weight for the paperboard is in the range of 280–320 pounds per three thousand square feet. Generally, the paperboard used is the same used in the manufacture of one-half gallon or one gallon milk container stock.

The side or body wall portion of the container is foldably connected to the base wall portion. The base wall portion comprises a plurality of foldably connected panels that are folded in such a manner as to form first and second upstanding members, with an annular channel being formed between the two upstanding members. The first upstanding member comprises at least one panel which lies in face-to-face contact with the lower surface of the cylindrical body wall portion. This panel is of greater height than the height of the second upstanding member. Optionally, the first upstanding member can consist of two foldably connected panels, wherein both such panels are either of approximately the same height, or wherein one panel is approximately twice the height of the second panel. The second upstanding member comprises two foldably connected panels. The innermost panel of the second upstanding member is joined at its bottom edge to the bottom edge of the side or body wall of the container. The other panel is joined at its lower edge to the lower edge of one of the panels comprising the first upstanding member.

A first end closure member, comprising a plastic plug, is preferably formed from high density polyethylene and seals the base portion of the container. The plug includes a downwardly projecting peripheral flange, or skirt portion, that occupies the annular channel formed between the two upstanding members. By this construction, the first upstanding member extends above the top surface of the lower end plug. A second end closure member, comprising an end cap or lid, is also preferably made from high density polyethylene and seals the upper end of the container. The second end closure member is generally press fitted over the top of the container.

The container so formed is rugged and is designed to maintain its substantially leakproof condition when its bottom edge is subjected to impact as a result of the dropping of the container during its shipment and/or storage.

The full nature of the invention will be understood from the accompanying drawings and the following description and claims:

BRIEF DESCRIPTION OF THE DRAWINGS

FIG. 5 is a perspective view of the completed container, which is one of the preferred embodiments of this invention.

FIG. 6 is a partial cross-section taken along the line 6–6 of FIG. 5.

FIG. 7 is a fragmentary, sectional view of the lower edge of another embodiment of a container according to this invention.

DETAILED DESCRIPTION OF THE INVENTION

Figure 1:
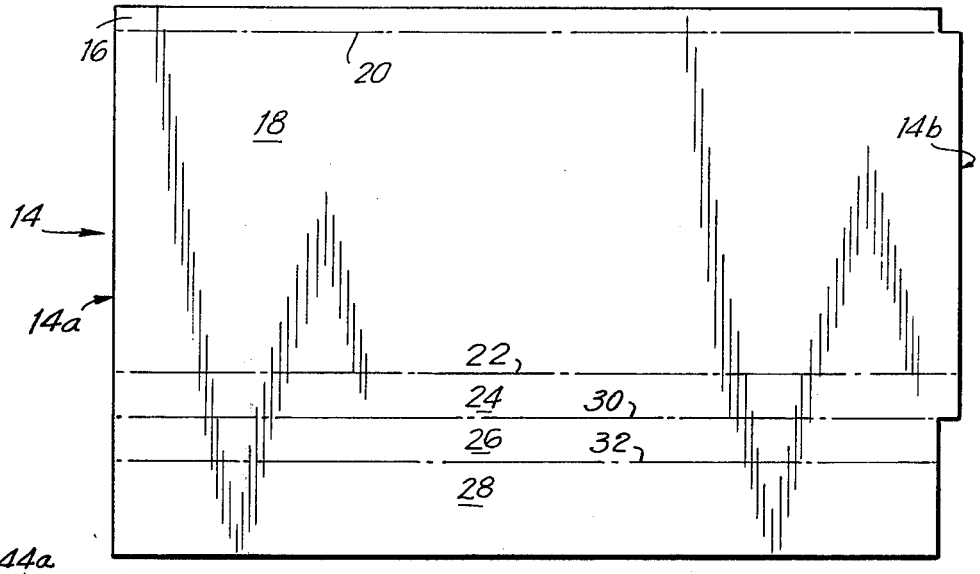
FIG. 1 is a plan view of a cut and scored blank which is used to form the container body illustrated in FIGS. 2–6.

FIGS. 1–6 represent a first preferred embodiment of the container of this invention. FIG. 1 shows the single piece blank 14 used to prepare the container body. Blank 14 comprises an optional first panel 16 at its upper edge, side or body wall portion 18 foldably attached to panel 16 by means of score line 20, and an integral base portion foldably connected to side wall portion 18 by means of score line 22. The base portion consists of three foldably connected panels, 24, 26, and 28 respectively. Panel 28 comprises the first upstanding member, and panels 24 and 26 comprise the second upstanding member. Panel 24 is foldably connected to panel 26 along score line 30, and score line 32 foldably connects panels 26 and 28. It will be noted that panels 26 and 28 are somewhat shorter in length than panels 24 and 18. This feature, which is optional, aids in improving the seal of the container when the blank from which it is formed is rolled into a cylinder and ultimately sealed. It will be appreciated that two layers of thermoplastic coated paperboard are eliminated when the panels are folded over on each other, as will be described hereinafter in more detail.

Paperboard blank 14 can be formed from conventional, thermoplastic coated paperboard base stock, such as the stock that is used in the manufacture of milk cartons. Blank 14 is coated preferably on both surfaces with a polyolefin, such as polyethylene or polypropylene, or a like material. Preferably, however, low density polyethylene is employed.

Blank 14 may be formed from paperboard base stock having a basis weight of from about 280 pounds to about 320 pounds per 3000 square feet, and a thickness of about 26 mils to about 32 mils. It is especially preferred that a paperboard base stock of about 320 pounds per 3000 square feet basis weight, and of about 30 mils thickness be utilized.

The thickness of the thermoplastic coating on blank 14 is not critical, but the thickness should be greater than about 0.75 mils, which is sufficient to enable a plastic-to-plastic bond to be formed between the thermoplastic coatings on the surfaces of the blank. Preferably, the thickness of the thermoplastic coatings on the surfaces of the blank 14 is from about 0.75 mils to about 1.0 mil, preferably about one mil.

In the blank 14, the exact size and configuration of panels 16, 18, 24, 26, and 28 are also not critical. However, as shown in the drawings and as will be discussed hereinafter, the elements of blank 14 preferably have a size and configuration adapted to cooperatively provide when erected: a generally cylindrical container body having a side wall portion formed from the generally rectangular panel 18; a base portion comprising a first upstanding member formed from the generally rectangular panel 28 and a second upstanding member formed from rectangular panels 24 and 26. In the blank 14, score lines 22 and 32 are preferably double score lines, so that when the panels are folded as the container is erected, unnecessary stress at these score lines, which is caused by the thickness of the base stock and the coating thereon, and which may result in cracks or fissures in the thermoplastic coating, will be avoided.

Figure 2:
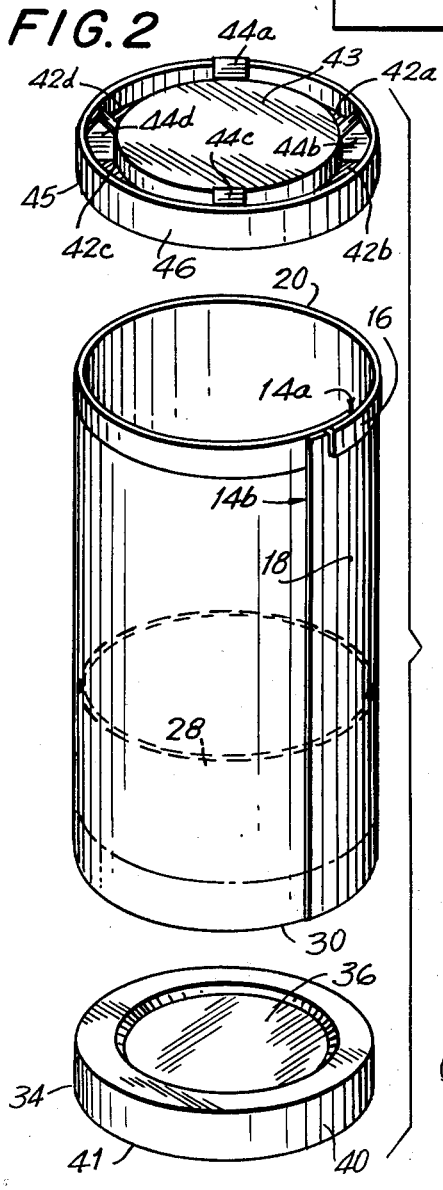
FIG. 2 is an exploded, perspective view of a container of this invention in one stage of its erection.
Figure 3:
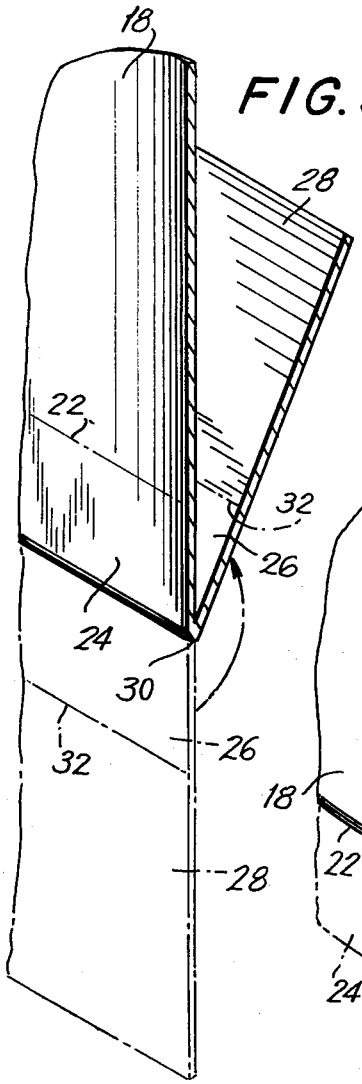
FIG. 3 is a partial perspective view of one stage of the folding operation.

As a first and optional step in forming the generally cylindrical, leak-resistant paperboard container body of this invention, panel 16 is folded outwardly about score line 20 to lie in face-to-face contact with the outer surface of side or body wall 18 and is bonded thereto by any conventional method. This "hem," which is illustrated in FIG. 2, provides strength and circumferential dimensional stability along the upper edge of the container. As schematically shown in FIG. 3, panels 26 and 28, as a single unit, are then rotated or folded inwardly about score line 30 to lie in face-to-face contact with the inner surfaces of panels 24 and 18 of the blank. Blank 14 is next rolled into a cylinder and is side seamed along the entire length of the blank. In forming the cylinder, the inner surface of the blank along edge **14*b* is bonded with the outer surface of the blank along edge 14*a*. The surfaces of the blank 14 can be bonded together to form the cylinder shown in FIG. 2 by any conventional method, such as by heat sealihg or by use of hot melt adhesives or by a combination thereof. It is preferable, though, if the surfaces of blank 14** are bonded together by forming a conventional, heat sealed, side seam bond between the thermoplastic coatings on the surfaces of the paperboard base stock.

Also schematically shown in FIG. 2, is the next step in forming the preferred container of this invention. This step involves the insertion of a first or lower end closure member 34 into the appropriate position in the cylindrical structure. End closure member 34 preferably comprises a plastic plug formed from high density polyethylene, but it will be obvious to those skilled in the art that other plastics, such as styrene and polypropylene, may also be used. End plug 34, in its preferred form, comprises a somewhat bowl-shaped top surface 36, to provide strength; and a depending downwardly directed peripheral flange or skirt portion 40, having an edge 41. It is inserted into the cylindrical structure through the lower end thereof until it reaches the point where lower edge 41 of the flange 40 is approximately at the same level as score line 32.

Figure 4:
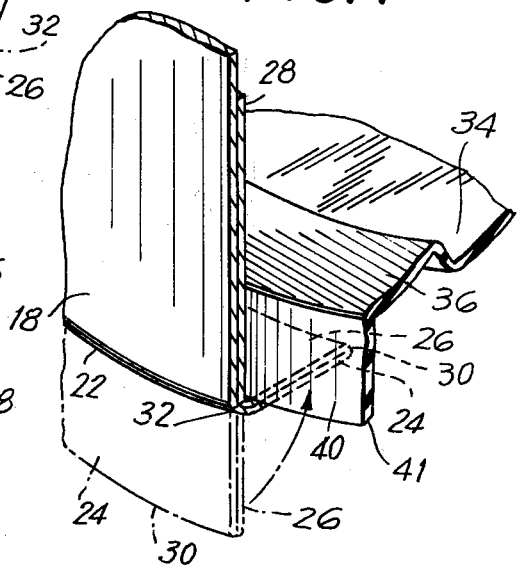
FIG. 4 depicts the next step in the folding sequence.

As then shown in FIG. 4, panels 24 and 26 are rotated and folded inwardly about flange 40 at score lines 22 and 32 respectively, until panel 26 is in intimate face-to-face contact with the inner surface of flange 40 of lower end plug 34. As will be obvious from the drawings, the diameter of the cylindrical form of the blank 14 is approximately the same as the diameter of the flanged portion 40 of end plug 34.

In order to provide a leakproof seal at the lower portion of the container, panels 18, 24, 26, and 28, and flange portion 40 of the end plug 34, are heat sealed together to form a rigid false bottom structure that is somewhat similar to the botton of a paper cup. At this point, the container, having the lower end plug 34 heat sealed in place, is ready to be filled with the liquid or moisture sensitive material that it is designed to hold.

When the container is completely full, a second end closure member, or upper end cap, 45 is press fitted over the upper edge of the container to overlie panel 16 and the upper edge portion of body wall 18. However, it has been found that the liquid material within the container expands as it freezes, thereby causing upper end cap 45 to loosen or "ride up." To prevent the upper end cap from loosening, it may be "tacked" to the container body by means of spot heat sealing or by use of spots of adhesive materials which may be placed around the circumference of the outer surface of panel 16.

As seen in FIG. 2, upper end cap 45 includes channels or grooves 42*a*, 42*b*, 42*c*, and 42*d*, around its perimeter. The channels 42 *a-d*, in this preferred but not mandatory embodiment, comprise four discrete segments. Each segment, optionally, may end at an upwardly projecting lug 44. End cap 45 also includes a depending outer peripheral flange, or skirt portion, 46, which is coextensive with the outer wall of channel 42. Lid 45 further includes a central, elevated circular panel 43, surrounded by channel 42. Preferably, end cap 45 is made from a plastic material, such as high density polyethylene. It will be obvious to those skilled in the art, however, that other plastics, such as styrene and polypropylene, may be used, as well as paperboard caps. Upper end cap 45 is generally formed as one, continuous plastic piece, and it may be formed by any conventional method of forming one piece plastic lids, such as by thermoforming or by injection molding. The same is true for lower end plug 34.

The containers of the present invention are provided with sufficient structural support to enable them to carry relatively heavy loads, i.e., 30 pounds of material. This structural support provides a further advantage in that the containers are weight bearing, so that they may be arranged in vertical stacks during their transportation and storage. As an aid in securing the containers when they are stacked on each other, a plurality of upwardly projecting lugs 44 are provided. Lugs 44 may, optionally, be spaced circumferentially around the upper surface of upper end cap 44. With reference to FIG. 2, it will be observed that the outer surfaces of the upper portion of projecting lugs 44 form a circle. The diameter of this circle, which is the distance between the outer surfaces of opposing lugs 44*a* and 44*c* (or 44*b* and 44*d*), is nearly the same as the inner diameter of the false bottom of the container, thereby enabling lugs 44 to fit snugly within the false bottom of the next superposed container in the stack. In a sense, then, the containers, when stacked, can be considered to be partially nested in each other.

FIG. 5 is a perspective view of the completed container, which is the preferred embodiment of this invention. FIG. 6 is a partial cross-section view taken along the line 6—6 of FIG. 5. It will be appreciated that FIG. 6 illustrates only a cross-sectional view of one-half of the completed container, since the other half of the container is merely a mirror image thereof. As seen in FIG. 6, the container body comprises a generally cylindrical side or body wall portion 18 and a base portion foldably connected thereto. It is formed from the unitary, thermoplastic coated paperboard blank shown in FIG. 1. Circumferential panel 16 is foldably connected to the upper edge of side or body wall portion 18. It overlies and is secured, either adhesively or by means of a heat seal, to the upper portion thereof. The base portion of the container, which is foldably connected to the lower edge of side wall 18, comprises a plurality of foldably connected panels 24, 26, and 28. These panels are folded in such a manner as to form a first upstanding member consisting of panel 28 and a second upstanding member consisting of panels 24 and 26, whereby said first and second upstanding members define an annular channel, which is occupied by flange 40 of end cap 34. First upstanding member 28 lies in face-to-face contact with the lower, inner surface of side wall 18, and is bonded thereto. Panel 28 is of greater height than the height of the second upstanding member, namely, panels 24 and 26, and extends upward into the container to a height greater than the height of the upper surface of end plug 34. Plug 34 is seated on score line 30, which joins panels 24 and 26, and flange 40 fits securely within the annular channel defined by the two upstanding members.

This embodiment is referred to as a "double wall inside" construction, which indicates that there are two "walls," 18 and 28, external to the flange 40 of plug 34 and that the first upstanding member is bonded to the inner surface of the container and, thus, lies between flange 40 and body wall 18.

An alternative embodiment is shown in FIG. 7. Since this embodiment is formed from the same unitary blank as is the container shown in FIG. 6, the same reference numerals used in FIG. 1–6 are employed in FIG. 7 as well. This embodiment is referred to as a "double wall outside" construction because there are two walls, 18 and 28, external to flange 40, and the first upstanding member, panel 28, while still in face-to-face contact with body wall portion 18, is bonded to the outer surface, rather than the inner surface, thereof.

In forming the container, the lower edge of which is shown in FIG. 7, panel 16 (not shown) may optionally be rotated and be folded outwardly about score line 20 to lie in face-to-face contact with the outer, upper surface of body wall 18 and be bonded thereto. Panels 26 and 28, as a single unit, are then folded outwardly about score line 30 to lie in face-to-face contact with the outer surfaces of panels 24 and 18 and are bonded thereto. Blank 14 is then folded into a cylinder and is side seamed along the entire length of the blank. Next, lower end closure 34 is inserted into the cylindrical structure, through the lower end thereof, until it reaches the point where lower edge 41 of flange 40 is approximately at the same level as score line 22. Panels 24 and 26 are next folded inwardly about flange 40 and about score lines 22 and 32 respectively, until panel 24 is in intimate face-to-face contact with the inner surface of flange 40 of plug 34. The leakproof seal for the lower portion of the container is achieved by bonding panels 18, 24, 26, and 28, and flange portion 40 of plug 34 together to form a rigid false bottom structure, by means of heat sealing or by use of hot melt adhesives, or by a combination thereof.

Figure 8:
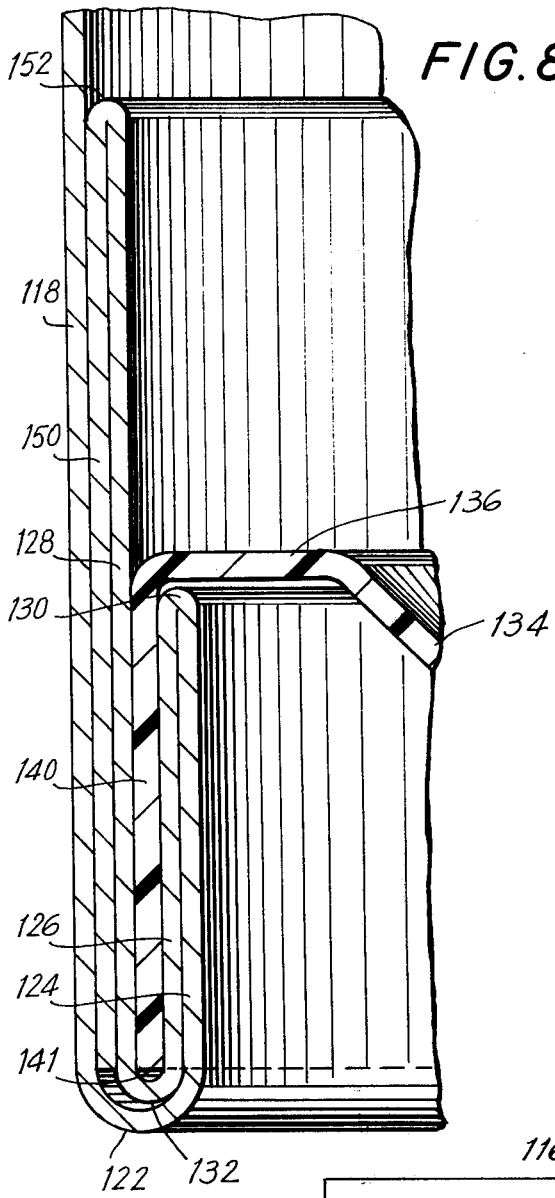
FIG. 8 is a fragmentary, sectional view of the lower edge of yet another embodiment of a container according to this invention.
Figure 9:
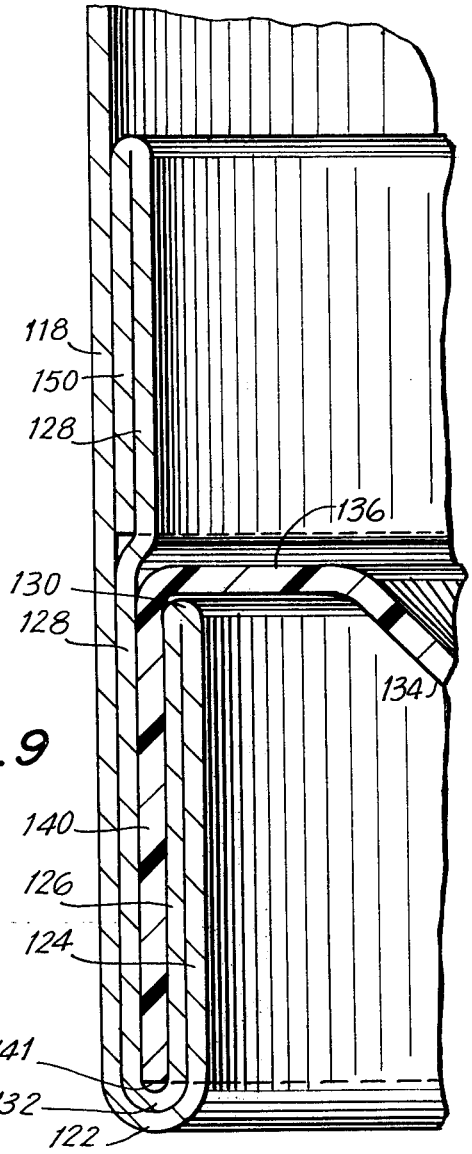
FIG. 9 is a fragmentary, sectional view of an alternative embodiment of the container illustrated in FIG. 8.
Figure 10:
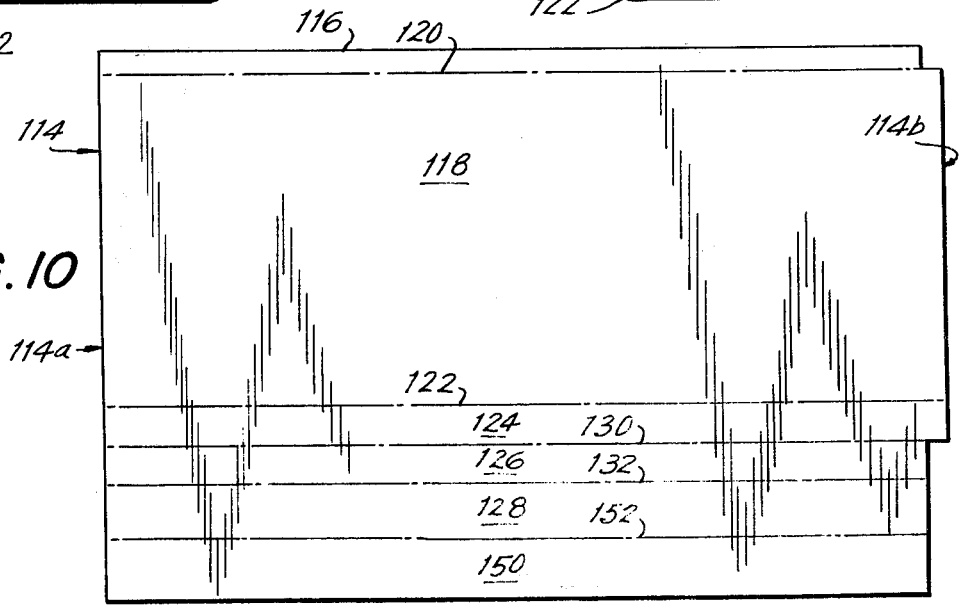
FIG. 10 is a plan view of the cut and scored blank used to form the body of the container, the lower edge of which is illustrated in FIG. 8.

FIGS. 8 and 9 illustrate partial cross-sectional views of the lower edges of possible alternative embodiments of the containers of this invention. FIG. 10 is a plan view of a cut and scored blank which is used to form the container body partially illustrated in FIG. 8. This blank may be modified somewhat, as will be hereinafter described, to form the container body partially illustrated in FIG. 9.

As seen in FIG. 10, blank 114 is essentially the same as the blank 14 of FIG. 1, except for the addition of generally rectangular panel 150, which is foldably connected to generally rectangular panel 128 by means of score line 152. It will be seen that panel 128 of the blank in FIG. 10 corresponds to panel 28 of blank 14 in FIG. 1. In forming the generally cylindrical, leak-resistant container partially illustrated in FIG. 8, panel 116 is first folded outwardly about score line 120 to lie in face-to-face contact with the outer surface of body wall 118 and is sealed thereto by any conventional method. Again, this "hem" imparts strength and circumferential dimensional stability to the upper edge of the container body and enables the container to be easily sealed by means of a generally circular end closure member. Panel 150 is then folded inwardly about score line 152 to lie in face-to-face contact with the inner surface of panel 128, and is bonded thereto. It will be noted that panels 128 and 150 are approximately the same width. Next, panels 126 and panels 128 and 150, which have been sealed together, are folded inwardly as a single unit about score line 130, so that panel 150 lies in face-to-face contact with the inner surface of body wall 118 and panel 126 lies in face-to-face contact with the inner surface of panel 124. The panels, which are now in intimate face-to-face contact, are then sealed together by the methods previously described. Blank 114 is then rolled into a cylinder and is side seamed along the entire length of the cylinder. In forming the cylinder, the inner surface of the blank along edge **114*b* is bonded to the outer surface of the blank along edge 114*a*.**

Once the paperboard body of the container has been formed, a first or lower end closure member 134, which preferably comprises a plastic plug, is inserted into the cylindrical structure, through the lower end thereof, until lower edge 141 of flange 140 is approximately at the same level as score line 132. Panels 126 and 124, which have been sealed together, are then folded inwardly about flange 140 at score lines 132 and 122, respectively, until panel 126 is in intimate face-to-face contact with the inner surface of flange 140 of lower end cap 134. The individual components of the base portion of the container, which, in this embodiment, comprise panels 124, 126, 128 150, and 118 and flange 141, are heat sealed together to form a rigid, false bottom structure.

As seen in FIG. 9, the width of panel 150 is approximately one-half the width of panel 128. This differs from the construction shown in FIG. 8, wherein the width of panel 150 is approximately equal to the width of panel 128. The embodiment partially illustrated in FIG. 8 is referred to as a "full triple wall" construction, since there are three "walls," namely panels 128, 150, and 118, external to flange 141. The embodiment illustrated in partial cross-section in FIG. 9, however, is referred to as a "half triple wall" construction, since one of the three "walls" external to flange 141, namely, panel 150, while above the level of upper surface 136 of plug 134, does not extend to the bottom of the container. Thus, there are only two "walls" namely, panels 128 and 118, external to flange 140. As shown in FIGS. 8 and 9, the base portion of each of these embodiments comprises a plurality of foldably connected panels, one of which is, in turn, foldably connected to the body wall portion of the container. The panels are folded to form first and second upstanding members which define an annular channel therebetween. In the embodiment partially shown in FIG. 8, the first upstanding member comprises panels 128 and 150, and panel 150 thereof lies in face-to-face contact with the cylindrical body wall 118. The second upstanding member comprises panels 124 and 126. Plug 134 is seated on the second upstanding member at score line 130, and the annular channel defined by the two upstanding members is, of course, the area in which flange 140 of plug 134 is located.

In the embodiment illustrated in partial cross-section in FIG. 9, panel 150 of the first upstanding member lies in face-to-face contact with body wall 118, as does the lower portion of panel 128.

Generally speaking, from the foregoing description it will be seen that the improved container according to this invention, in any of the forms illustrated herein, consists of a generally cylindrical body wall portion foldably connected to which is a base wall portion. It is constructed from a unitary, thermoplastic coated paperboard blank. The base wall portion comprises a plurality of foldably connected panels, with the panels being folded in such a manner as to form first and second upstanding members which define an annular channel therebetween. The first of the upstanding members comprises at least one panel which lies in face-to-face contact with the lower end of the cylindrical body wall portion of the container. In all the embodiments shown, the first upstanding member is of greater height than the second upstanding member, and it extends upwards, either into the container or along the lower, outer surface of the side wall of the container, to a height greater than that of the upper surface of the base closure member. It will be appreciated that the first upstanding member serves to reinforce the side wall of the container in the area where the side wall meets the base closure member. The base closure member comprises a plug that includes a downwardly projecting peripheral flange for sealing the base of the cylindrical container, wherein the plug is seated on the second upstanding member and the flange occupies the annular channel between the two upstanding members. A second end closure member or over cap is press fitted over and seals the upper end of the container.

It has been found that when containers according to the present invention are filled with the goods that they are to hold, and are in use in commerce, they will be carried approximately at waist level by the average worker when they are carried to and from a loading dock or when taken from frozen storage prior to use. Accordingly, when they are dropped, it has been found that they will be dropped a distance of approximately three feet. When containers according to the present invention were filled with thirty pounds of water, and the water was then frozen, the side wall of the containers, which are, in effect, reinforced, after being subjected to a three-foot edge or corner drop, did not fracture or burst, and the integrity of the leakproof barrier of the base portion of the container was maintained. This is what is meant in the specification and the claims by the terms "leakproof container," "substantially leakproof container," and "leak-resistant container."

Although the invention has been described above by reference to a number of illustrative embodiments, it will be appreciated that other container constructions may be devised which are, nevertheless, within the scope and spirit of the invention and are defined by the claims appended hereto.

What is claimed is:

1. A leakproof, three-piece container suitable for shipping and storing liquids, frozen liquids, moisture sensitive materials and the like, which maintains its leakproof condition when subjected to impact occasioned by the dropping of the container on its base portion during shipping and storage, comprising:

a generally cylindrical body wall portion and base wall portion constructed from a unitary, thermoplastic coated paperboard blank, said body wall portion foldably connected to said base wall portion; said base wall portion comprising a plurality of foldably connected panels, said panels being folded to form first and second upstanding members defining an annular channel therebetween; said first upstanding member comprising at least one panel, which panel lies in face-to-face contact with the lower surface of said cylindrical body wall portion, wherein at least said one panel of said first upstanding member is of greater height than the height of the second upstanding member;

a first end closure member having a downwardly projecting peripheral flange for sealing the lower end of the container, said flange occupying the annular channel formed between said first and second upstanding members; and a second end closure member for sealing the upper end of said container.

2. The leakproof, three-piece container of claim 1 in which the lower end closure member is supported by the second upstanding member of the base wall portion of the container.

3. The leakproof, three-piece container of claim 1 in which the thermoplastic material is polyethylene.

4. The leakproof, three-piece container of claim 1 in which the first and second end closure members are composed of polyethylene.

5. The leakproof, three-piece container of claim 1 wherein the first upstanding member extends upward into the container body to a height greater than the height of the top surface of said lower end closure member.

6. The leakproof, three-piece container of claim 5 wherein the lower surface of the cylindrical body wall portion, each of the panels comprising the first and second upstanding members, and the peripheral flange portion of said first end closure member are bonded together to form a rigid false bottom structure.

7. The leakproof, three-piece container of claim 6 wherein said bonding is achieved by means of a heat seal.

8. The leakproof, three-piece container of claim 6 wherein said bonding is achieved by use of hot melt adhesives.

9. The leakproof, three-piece container of claim 6 which includes a panel foldably connected to the upper edge of the cylindrical body wall portion of the container, said panel overlying and being adhered to the outer surface of the upper portion of the cylindrical body wall portion to provide strength and dimensional stability thereto.

10. The leakproof, three-piece container of claim 9 wherein the upper closure member is press fitted over and seals the upper end of the container.

11. The leakproof, three-piece container of claim 10 wherein the upper closure member comprises a paperboard over cap.

12. A leakproof, three-piece container suitable for shipping and storing liquids, frozen liquids, moisture sensitive materials and the like, which maintains its leakproof condition when subjected to impact occasioned by the dropping of the container on its base portion during shipping and storage, comprising:

a generally cylindrical body wall portion and base wall portion constructed from a unitary, thermoplastic coated paperboard blank, said body wall portion foldably connected to said base wall portion; said base wall portion comprising three foldably connected panels, said panels being folded to form first and second upstanding members defining an annular channel therebetween; said first upstanding member comprising one panel that lies in face-to-face contact with the lower surface of said cylindrical body wall portion, is of greater height than the height of the second upstanding member, and is foldably attached along its bottom edge to one panel of said second upstanding member, said other panel of said second upstanding member being foldably attached along its bottom edge to the cylindrical body wall portion of the container;

a first end closure member having a downwardly projecting peripheral flange for sealing the lower end of the container, said flange occupying the annular channel formed between said first and second upstanding members; and a second end closure member for sealing the upper end of the container.

13. The leakproof, three-piece container of claim 12 wherein the lower surface of the cylindrical body wall portion, each of the panels comprising the first and second upstanding members, and the peripheral flange portion of the lower end closure member are bonded together to form a rigid false bottom structure.

14. The leakproof, three-piece container of claim 13 wherein said bonding is achieved by means of a heat seal.

15. The leakproof, three-piece container of claim 13 wherein said bonding is achieved by use of hot melt adhesives.

16. The leakproof, three-piece container of claim 13 wherein said panel comprising the first upstanding member lies in face-to-face contact with the lower, inner surface of the cylindrical body wall portion and extends upward into the container body to a height greater than the height of the top surface of said lower end closure member.

17. The leakproof, three-piece container of claim 13 wherein said panel comprising the first upstanding member lies in face-to-face contact with the lower, outer surface of the cylindrical body wall portion.

18. The leakproof, three-piece container of claim 13 wherein the thermoplastic material is polyethylene.

19. The leakproof, three-piece container of claim 13 in which said first and second end closure members are composed of a thermoplastic material.

20. The leakproof, three-piece container of claim 19 in which the thermoplastic material is polyethylene.

21. The leakproof, three-piece container of claim 20 wherein the upper closure member is press fitted over and seals the upper end of the container.

22. The leakproof, three-piece container of claim 13 which includes means for securing a plurality of said containers which are arranged in a vertical stack during their transportation or storage, said securing means comprising a plurality of upwardly projecting lugs, said lugs being spaced about the circumference of the upper surface of the upper end cap, wherein the outer diameter of the circle formed by the outer surfaces of each of said lugs is nearly equal to the inner diameter of the false bottom of the container, thereby enabling said lugs to fit snugly within the false bottom of the next superposed container in the stack.

23. A leakproof, three-piece container suitable for shipping and storing liquids, frozen liquids, moisture sensitive materials and the like, which maintains its leakproof condition when subjected to impact occasioned by the dropping of the container on its base portion during shipping and storage, comprising:

a generally cylindrical body wall portion and base wall portion constructed from a unitary, thermoplastic coated paperboard blank, said body wall portion foldably connected to said base wall portion; said base wall portion comprising four foldably connected panels, said panels being folded to form first and second upstanding members defining an annular channel therebetween; said first upstanding member being of greater height than the height of said second upstanding member and comprising two panels foldably attached along their upper edges, one of said panels lying in face-to-face contact with the lower inner surface of said cylindrical body wall portion; said second upstanding member comprising two panels, one of said panels being foldably attached along its bottom edge to one panel of said first upstanding member, said other panel of said second upstanding member being foldably attached along its bottom edge to the cylindrical body wall portion of the container;

a first end closure member having a downwardly projecting peripheral flange for sealing the lower end of the container, said flange occupying the annular channel formed between said first and second upstanding members; and a second end closure member for sealing the upper end of the container.

24. The leakproof, three-piece container of claim 23 wherein the lower surface of the cylindrical body wall portion, each of the panels comprising the first and second upstanding members, and the peripheral flange portion of the lower end closure member are bonded together to form a rigid false bottom structure.

25. The leakproof, three-piece container of claim 24 wherein said bonding is achieved by means of a heat seal.

26. The leakproof, three-piece container of claim 24 wherein said bonding is achieved by use of hot melt adhesives.

27. The leakproof, three-piece container of claim 24 wherein said two panels forming the first upstanding member are of approximately the same height.

28. The leakproof, three-piece container of claim 24 wherein one of the two panels comprising the first upstanding member is approximately twice the height of the other panel.

29. The leakproof, three-piece container of claim 24 wherein said two panels comprising the first upstanding member extend upward into the container body to a height greater than the height of the top surface of said lower end closure member.

30. The leakproof, three-piece container of claim 24 in which said first and second end closure members are composed of a thermoplastic material.

31. The leakproof, three-piece container of claim 30 in which the thermoplastic material is polyethylene.

32. The leakproof, three-piece container of claim 24 wherein the upper closure member is press fitted over and seals the upper end of the container.

33. The leakproof, three-piece container of claim 32 which includes means for securing a plurality of said containers which are arranged in a vertical stack during their transportation or storage, said securing means comprising a plurality of upwardly projecting lugs, said lugs being spaced about the circumference of the upper surface of the upper end cap, wherein the outer diameter of the circle formed by the outer surfaces of each of said lugs is nearly equal to the inner diameter of the false bottom of the container, thereby enabling said lugs to fit snugly within the false bottom of the next superposed container in the stack.

* * * * *